US010876182B2

(12) United States Patent
Yuga et al.

(10) Patent No.: US 10,876,182 B2
(45) **Date of Patent: *Dec. 29, 2020**

(54) HIGH-STRENGTH SEAMLESS STEEL PIPE FOR OIL COUNTRY TUBULAR GOODS AND METHOD OF PRODUCING THE SAME

(71) Applicant: JFE STEEL CORPORATION, Tokyo (JP)

(72) Inventors: Masao Yuga, Handa (JP); Yasuhide Ishiguro, Handa (JP); Seiji Nabeshima, Kurashiki (JP); Mitsuhiro Okatsu, Handa (JP); Hiroki Ota, Handa (JP)

(73) Assignee: JFE STEEL CORPORATION, Tokyo (JP)

( * ) Notice: Subject to any disclaimer, the term of this patent is extended or adjusted under 35 U.S.C. 154(b) by 473 days.

This patent is subject to a terminal disclaimer.

(21) Appl. No.: 15/537,669

(22) PCT Filed: Sep. 10, 2015

(86) PCT No.: PCT/JP2015/004621

§ 371 (c)(1),
(2) Date: Jun. 19, 2017

(87) PCT Pub. No.: WO2016/103537

PCT Pub. Date: Jun. 30, 2016

(65) Prior Publication Data

US 2017/0349963 A1 Dec. 7, 2017

(30) Foreign Application Priority Data

Dec. 24, 2014 (JP) ..... 2014-260217

(51) Int. Cl.

| | |
|---|---|
| ***C21D 1/18*** | (2006.01) |
| ***C21D 8/10*** | (2006.01) |
| ***C21D 9/08*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/14*** | (2006.01) |
| ***C22C 38/18*** | (2006.01) |
| ***C22C 38/22*** | (2006.01) |
| ***C22C 38/24*** | (2006.01) |
| ***C22C 38/26*** | (2006.01) |
| ***C22C 38/32*** | (2006.01) |
| ***C22C 38/42*** | (2006.01) |
| ***C22C 38/44*** | (2006.01) |

(Continued)

(52) U.S. Cl.

CPC ..... *C21D 9/085* (2013.01); *C21D 1/18* (2013.01); *C21D 6/004* (2013.01); *C21D 6/005* (2013.01); *C21D 6/008* (2013.01); *C21D 8/10* (2013.01); *C21D 8/105* (2013.01); *C21D 9/08* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/14* (2013.01); *C22C 38/18* (2013.01); *C22C 38/22* (2013.01); *C22C 38/24* (2013.01); *C22C 38/26* (2013.01); *C22C 38/32* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C21D 2211/008* (2013.01)

(58) Field of Classification Search

CPC . C21D 9/08; C21D 9/085; C21D 9/46; C21D 6/004; C21D 6/005; C21D 6/008; C21D 8/10; C21D 8/105; C22C 38/00; C22C 38/001; C22C 38/002; C22C 38/02; C22C 38/04; C22C 38/06; C22C 38/14; C22C 38/18; C22C 38/22; C22C 38/24; C22C 38/26; C22C 38/32; C22C 38/42; C22C 38/44; C22C 38/46; C22C 38/48; C22C 38/50; C22C 38/54

USPC ..... 148/320, 333, 334, 593

See application file for complete search history.

(56) References Cited

U.S. PATENT DOCUMENTS

| | | | |
|---|---|---|---|
| 4,075,041 | A | 2/1978 | Ueno et al. |
| 5,938,865 | A | 8/1999 | Kondo et al. |

(Continued)

FOREIGN PATENT DOCUMENTS

| | | | |
|---|---|---|---|
| CA | 2849287 | A1 | 9/2013 |
| CA | 2888154 | A1 | 5/2014 |

(Continued)

OTHER PUBLICATIONS

Non Final Office Action for U.S. Appl. No. 15/509,350, dated Apr. 16, 2019, 17 pages.

(Continued)

*Primary Examiner* — Brian D Walck

(74) *Attorney, Agent, or Firm* — RatnerPrestia

(57) ABSTRACT

A high-strength seamless steel pipe for oil country tubular goods comprising, by mass %, C: 0.20% to 0.50%, Si: 0.05% to 0.40%, Mn: 0.3% to 0.9%, P: 0.015% or less, S: 0.005% or less, Al: 0.005% to 0.1%, N: 0.006% or less, Mo: more than 1.0% to 3.0% or less, V: 0.01% to less than 0.05%, Nb: 0.001% to less than 0.01%, B: 0.0003% to 0.0030%, O: 0.0030% or less, and Ti: 0.003% to 0.025%, and wherein Ti/N: 2.0 to 5.0 is satisfied, a volume fraction of a tempered martensitic is 95% or more, prior austenite grains have a grain size number of 8.5 or more, and in a cross-section perpendicular to a rolling direction, the number of nitride-based inclusions having a grain size of 4 μm or more is 100 or less per 100 $mm^2$, the number of nitride-based inclusions having a grain size of less than 4 μm is 1000 or less per 100 $mm^2$, the number of oxide-based inclusions having a grain size of 4 μm or more is 40 or less per 100 $mm^2$, and the number of oxide-based inclusions having a grain size of less than 4 μm is 400 or less per 100 $mm^2$.

12 Claims, No Drawings

(51) Int. Cl.

| | |
|---|---|
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 6/00*** | (2006.01) |

(56) References Cited

U.S. PATENT DOCUMENTS

| | | | | |
|---|---|---|---|---|
| 6,267,828 | B1 | 7/2001 | Kushida et al. | |
| 9,708,681 | B2 | 7/2017 | Eguchi et al. | |
| 2004/0238075 | A1 | 12/2004 | Kondo | |
| 2005/0183799 | A1 | 8/2005 | Sakamoto | |
| 2006/0016520 | A1 | 1/2006 | Numato et al. | |
| 2006/0073352 | A1 | 4/2006 | Amaya et al. | |
| 2008/0105337 | A1 | 5/2008 | Kobayashi et al. | |
| 2008/0219878 | A1 | 9/2008 | Kondo et al. | |
| 2009/0098403 | A1 | 4/2009 | Omura et al. | |
| 2011/0315276 | A1 | 12/2011 | Bosch et al. | |
| 2012/0186704 | A1* | 7/2012 | Eguchi ..... | C21D 9/14 148/500 |
| 2014/0352836 | A1 | 12/2014 | Eguchi et al. | |
| 2015/0041030 | A1 | 2/2015 | Kondo et al. | |
| 2017/0275715 | A1 | 9/2017 | Yuga et al. | |
| 2017/0349963 | A1 | 12/2017 | Yuga et al. | |
| 2017/0349964 | A1 | 12/2017 | Yuga et al. | |
| 2018/0327881 | A1 | 11/2018 | Yuga et al. | |
| 2019/0024201 | A1 | 1/2019 | Yuga et al. | |
| 2019/0048443 | A1 | 2/2019 | Okatsu et al. | |
| 2019/0048444 | A1 | 2/2019 | Okatsu et al. | |

FOREIGN PATENT DOCUMENTS

| | | | |
|---|---|---|---|
| EP | 2796587 | | 10/2014 |
| JP | 2000178682 | A | 6/2000 |
| JP | 2000297344 | A | 10/2000 |
| JP | 2001172739 | A | 6/2001 |
| JP | 2006028612 | A | 2/2006 |
| JP | 2007016291 | A | 1/2007 |
| JP | 2012519238 | A | 8/2012 |
| JP | 2014012890 | A | 1/2014 |
| JP | 2014129594 | A | 7/2014 |
| WO | 2013094179 | | 6/2013 |

OTHER PUBLICATIONS

European Communication for European Application No. 15 872 120.9, dated Jun. 27, 2018, 4 pages.

Non Final Office Action for U.S. Appl. No. 15/527,893, dated Jun. 24, 2019, 28 pages.

Extended European Search Report for European Application No. 15872120.9, dated Nov. 14, 2017, 12 pages.

International Search Report and Written Opinion for International Application No. PCT/JP2015/004621, dated Dec. 8, 2015.

Final Office Action for U.S. Appl. No. 15/509,350, dated Sep. 5, 2019, 12 pages.

Non Final Office Action for U.S. Appl. No. 15/509,361, dated Feb. 25, 2019, 20 pages.

Final Office Action for U.S. Appl. No. 15/527,893, dated Jan. 6, 2020, 21 pages.

Non Final Office Action for U.S. Appl. No. 15/537,703, dated Oct. 30, 2019, 11 pages.

Final Office Action for U.S. Appl. No. 15/509,350, dated Sep. 5, 2019, 20 pages.

Non Final Office Action for U.S. Appl. No. 16/078,919, dated Jul. 10, 2020, 51 pages.

Non Final Office Action for U.S. Appl. No. 16/078,924, dated Jul. 24, 2020, 49 pages.

Non Final Office Action for U.S. Appl. No. 16/078,927, dated May 28, 2020, 36 pages.

Final Office Action for U.S. Appl. No. 15/527,893, dated Aug. 19, 2020, 7 pages.

* cited by examiner

HIGH-STRENGTH SEAMLESS STEEL PIPE FOR OIL COUNTRY TUBULAR GOODS AND METHOD OF PRODUCING THE SAME

CROSS REFERENCE TO RELATED APPLICATIONS

This is the U.S. National Phase application of PCT/JP2015/004621, filed Sep. 10, 2015, which claims priority to Japanese Patent Application No. 2014-260217, filed Dec. 24, 2014, the disclosures of each of these applications being incorporated herein by reference in their entireties for all purposes.

TECHNICAL FIELD OF THE INVENTION

The present invention relates to a high-strength seamless steel pipe suitable for oil country tubular goods and particularly relates to an improvement in sulfide stress cracking resistance (hereinafter referred to as "SSC resistance") in a wet hydrogen sulfide environment (sour environment).

BACKGROUND OF THE INVENTION

In recent years, from the view point of stable securement of energy resources, oil wells and natural gas wells at a deep depth in a severe corrosive environment have been developed. Therefore, for oil country tubular goods, SSC resistance in a sour environment containing hydrogen sulfide ($H_2S$) is strongly required to be superior while maintaining a high yield strength YS of 125 ksi (862 MPa) or higher.

In order to satisfy the requirements, for example, PTL 1 discloses a method of producing steel for oil country tubular goods, the method including: preparing low alloy steel containing, by weight %, C: 0.2% to 0.35%, Cr: 0.2% to 0.7%, Mo: 0.1% to 0.5%, and V: 0.1% to 0.3%; quenching the low alloy steel at an $Ac_3$ transformation point or higher; and tempering the low alloy steel in a temperature range of 650° C. to an $Ac_1$ transformation point. According to the technique disclosed in PTL 1, the low alloy steel can be adjusted such that a total amount of precipitated carbides is 2 wt % to 5 wt %, and a ratio of an MC carbide to the total amount of the precipitated carbides is 8 wt % to 40 wt %. Therefore, steel for oil country tubular goods having superior sulfide stress cracking resistance can be obtained.

In addition, PTL 2 discloses a method of producing steel for oil country tubular goods having superior toughness and sulfide stress cracking resistance, the method including: preparing low alloy steel containing, by mass %, C: 0.15% to 0.3%, Cr: 0.2% to 1.5%, Mo: 0.1% to 1%, V: 0.05% to 0.3%, and Nb: 0.003% to 0.1%; heating the low alloy steel to 1150° C. or higher; finishing hot working at 1000° C. or higher; and performing a quenching-tempering treatment on the low alloy steel at least once in which the low alloy steel is quenched at a temperature of 900° C. or higher, is tempered in a range of 550° C. to an $Ac_1$ transformation point, is quenched by reheating it in a range of 850° C. to 1000° C., and is tempered in a range of 600° C. to the $Ac_1$ transformation point. According to the technique disclosed in PTL 2, the low alloy steel can be adjusted such that a total amount of precipitated carbides is 1.5 mass % to 4 mass %, a ratio of an MC carbide to the total amount of the precipitated carbides is 5 mass % to 45 mass %, and a ratio of an $M_{23}C_6$ carbide to the total amount of the precipitated carbides is 200/t (t: wall thickness (mm)) or less. Therefore, steel for oil country tubular goods having superior toughness and sulfide stress cracking resistance can be obtained.

In addition, PTL 3 discloses steel for oil country tubular goods containing, by mass %, C: 0.15% to 0.30%, Si: 0.05% to 1.0%, Mn: 0.10% to 1.0%, P: 0.025% or less, S: 0.005% or less, Cr: 0.1% to 1.5%, Mo: 0.1% to 1.0%, Al: 0.003% to 0.08%, N: 0.008% or less, B: 0.0005% to 0.010%, and Ca+O (oxygen): 0.008% or less and further containing one element or two or more elements of Ti: 0.005% to 0.05%, Nb: 0.05% or less, Zr: 0.05% or less, and V: 0.30% or less, in which a maximum continuous length of non-metallic inclusions in cross-section observation is 80 μm or shorter, and the number of non-metallic inclusions having a grain size of 20 μm or more in the cross-section observation is 10 inclusions/100 $mm^2$ or less. As a result, low alloy steel for oil country tubular goods which has high strength required for oil country tubular goods and has superior SSC resistance corresponding to the strength can be obtained.

In addition, PTL 4 discloses low alloy steel for oil country tubular goods having superior sulfide stress cracking resistance, the steel containing, by mass %, C: 0.20% to 0.35%, Si: 0.05% to 0.5%, Mn: 0.05% to 0.6%, P: 0.025% or less, S: 0.01% or less, Al: 0.005% to 0.100%, Mo: 0.8% to 3.0%, V: 0.05% to 0.25%, B: 0.0001% to 0.005%, N: 0.01% or less, and O: 0.01% or less, in which $12V+1-Mo \geq 0$ is satisfied. According to the technique disclosed in PTL 4, in addition to the above-described composition, the steel may further contain, by mass %, Cr: 0.6% or less such that $Mo—(Cr+Mn) \geq 0$ is satisfied, may further contain one or more elements of Nb: 0.1% or less, Ti: 0.1% or less, and Zr: 0.1% or less, or may further contain Ca: 0.01% or less.

PATENT LITERATURE

[PTL 1] JP-A-2000-178682
[PTL 2] JP-A-2000-297344
[PTL 3] JP-A-2001-172739
[PTL 4] JP-A-2007-16291

SUMMARY OF THE INVENTION

However, there are various factors affecting sulfide stress cracking resistance (SSC resistance). Therefore, it cannot be said that the application of only the techniques disclosed in PTLS 1 to 4 is sufficient for improving SSC resistance of a high-strength seamless steel pipe having a yield strength (YS) of 125 ksi (862 MPa) or higher to a degree that is sufficient for oil country tubular goods in a severe corrosive environment. Moreover, there are problems in that it is significantly difficult to stably adjust the kinds and amounts of the carbides disclosed in PTLS 1 and 2 and the shapes and numbers of the non-metallic inclusions disclosed in PTL 3 to be within the desired ranges.

The present invention has been made in order to solve the problems of the related art, and an object thereof is to provide a high-strength seamless steel pipe for oil country tubular goods having superior sulfide stress cracking resistance; and a method of producing the same.

"High strength" described herein refers to a yield strength (YS) being 125 ksi (862 MPa) or higher. In addition, "superior sulfide stress cracking resistance" described herein refers to a case where no cracking occurs with an applied stress of 85% of the yield strength of a specimen for over 720 hours (time) when a constant-load test is performed in an acetic acid-sodium acetate solution (liquid temperature: 24° C.) saturated with hydrogen sulfide at 10 kPa, having an adjusted pH of 3.5, and containing 5.0 mass % of sodium chloride solution according to a test method defined in NACE TMO177 Method A.

In order to achieve the above-described objects, it is necessary to simultaneously realize desired high strength and superior SSC resistance. Therefore, the present inventors thoroughly investigated various factors affecting strength and SSC resistance. As a result, it was found that, in a high-strength steel pipe having a yield strength YS of 125 ksi or higher, nitride-based inclusions and oxide-based inclusion have a significant effect on SSC resistance although the effect varies depending on the sizes thereof. It was found that nitride-based inclusion having a grain size of 4 μm or more and oxide-based inclusions having a grain size of 4 μm or more cause sulfide stress cracking (SSC), and SSC is likely to occur as the sizes thereof increase. It was found that the presence of a single nitride-based inclusion having a grain size of less than 4 μm does not cause SSC; however, the nitride-based inclusions having a grain size of less than 4 μm adversely affect SSC resistance when the number thereof is large. In addition, it was also found that oxide-based inclusion having a grain size of less than 4 μm adversely affect SSC resistance when the number thereof is large.

Therefore, the present inventors thought that, in order to further improve SSC resistance, it is necessary to adjust the numbers of nitride-based inclusions and oxide-based inclusions to be appropriate numbers or less depending on the sizes thereof. In order to adjust the numbers of nitride-based inclusions and oxide-based inclusions to be appropriate numbers or less, it is important to control the N content and the O (oxygen) content to be in desired ranges during the preparation of a steel pipe raw material, particularly, during the melting and casting of molten steel. Moreover, control in a refining process of molten steel is important. Moreover, control of producing conditions in a refining process and a continuous casting process of molten steel is important.

The present inventors performed additional investigation based on the above findings and completed the present invention. That is, the summary of embodiments of the present invention is as follows.

(1) A high-strength seamless steel pipe for oil country tubular goods having a yield strength (YS) of 862 MPa or higher, the steel pipe including, as a composition, by mass %, C: 0.20% to 0.50%,
Si: 0.05% to 0.40%,
Mn: 0.3% to 0.9%,
P: 0.015% or less,
S: 0.005% or less,
Al: 0.005% to 0.1%,
N: 0.006% or less,
Mo: more than 1.0% and 3.0% or less,
V: 0.01% or more and less than 0.05%,
Nb: 0.001% or more and less than 0.01%,
B: 0.0003% to 0.0030%,
O (oxygen): 0.0030% or less,
Ti: 0.003% to 0.025%, and a remainder including Fe and unavoidable impurities, in which contents of Ti and N are adapted to satisfy Ti/N: 2.0 to 5.0, tempered martensite has a volume fraction of 95% or more, prior austenite grains have a grain size number of 8.5 or more, and in a cross-section perpendicular to a rolling direction, the number of nitride-based inclusions having a grain size of 4 μm or more is 100 or less per 100 $mm^2$, the number of nitride-based inclusions having a grain size of less than 4 μm is 1000 or less per 100 $mm^2$, the number of oxide-based inclusions having a grain size of 4 μm or more is 40 or less per 100 $mm^2$, and the number of oxide-based inclusions having a grain size of less than 4 μm is 400 or less per 100 $mm^2$.

(2) The high-strength seamless steel pipe for oil country tubular goods according to (1), further including, one element or more elements selected from, by mass %, Cr: 0.6% or less,
Cu: 1.0% or less,
Ni: 1.0% or less, and
W: 3.0% or less.

(3) The high-strength seamless steel pipe for oil country tubular goods according to (1) or (2), further comprising, by mass %, Ca: 0.0005% to 0.0050%.

(4) A method of producing a high-strength seamless steel pipe for oil country tubular goods, the seamless steel pipe being the high-strength seamless steel pipe for oil country tubular goods according to any one of (1) to (3), and the method including:

heating the steel pipe raw material to a heating temperature within a range of 1050° C. to 1350° C.;

performing hot working on the heated steel pipe raw material to form a seamless steel pipe having a predetermined shape;

cooling the seamless steel pipe at a cooling rate equal to or higher than that of air cooling after the hot working until a surface temperature of the seamless steel pipe reaches 200° C. or lower; and performing a tempering treatment in which the seamless steel pipe is heated to a temperature in a range of 600° C. to 740° C.

(5) The method of producing a high-strength seamless steel pipe for oil country tubular goods according to (4), performing a quenching treatment on the seamless steel pipe at least once after the cooling and before the tempering treatment in which the seamless steel pipe is reheated to a temperature in a range of an $Ac_3$ transformation point to 1000° C. or lower and is rapidly cooled until the surface temperature of the seamless steel pipe reaches 200° C. or lower.

According to embodiments of the present invention, a high-strength seamless steel pipe for oil country tubular goods having a high yield strength YS of 125 ksi (862 MPa) or higher and superior sulfide stress cracking resistance can be easily produced at a low cost, and industrially significant advantages are exhibited. According to embodiments of the present invention, appropriate alloy elements are contained in appropriate amounts, and the production of nitride-based inclusions and oxide-based inclusions is suppressed. As a result, a high-strength seamless steel pipe having a desired high strength for oil country tubular goods and superior SSC resistance can be stably produced.

DETAILED DESCRIPTION OF EMBODIMENTS OF THE INVENTION

First, the reason for limiting the composition of a high-strength seamless steel pipe according to embodiments of the present invention will be described. Hereinafter, "mass %" in the composition will be referred to simply as "%".

C: 0.20% to 0.50%

C contributes to an increase in the strength of steel by being solid-solubilized therein and also contributes to the formation of a microstructure containing martensite as a main phase during quenching by improving the hardenability of steel. In order to obtain the above-described effects, the C content is necessarily 0.20% or more. On the other hand, when the C content is more than 0.50%, cracking occurs during quenching, and the productivity significantly decreases. Therefore, the C content is limited to a range of 0.20% to 0.50%. Preferably, the C content is 0.20% to 0.35%. More preferably, the C content is 0.24% to 0.32%.

Si: 0.05% to 0.40%

Si is an element which functions as a deoxidizing agent and has an effect of increasing the strength of steel by being solid-solubilized therein and an effect of suppressing softening during tempering. In order to obtain the above-described effects, the Si content is necessarily 0.05% or more. On the other hand, when the Si content is more than 0.40%, the formation of ferrite as a soft phase is promoted, desired high-strengthening is inhibited, the formation of coarse oxide-based inclusions is promoted, and SSC resistance and toughness deteriorate. In addition, Si is an element which locally hardens steel by being segregated. Therefore, the addition of a large amount of Si, more than 0.40%, has an adverse effect in that a locally hard region is formed to deteriorate SSC resistance. Therefore, in embodiments of the present invention, the Si content is limited to a range of 0.05% to 0.40%. Preferably, the Si content is 0.05% to 0.30%. More preferably, the Si content is 0.24% to 0.30%.

Mn: 0.3% to 0.9%

Like C, Mn is an element which improves the hardenability of steel and contributes to an increase in the strength of steel. In order to obtain the above-described effects, the Mn content is necessarily 0.3% or more. On the other hand, Mn is an element which locally hardens steel by being segregated. Therefore, the addition of a large amount of Mn has an adverse effect in that a locally hard region is formed to deteriorate SSC resistance. Therefore, in embodiments of the present invention, the Mn content is limited to a range of 0.3% to 0.9%. Preferably, the Mn content is 0.4% to 0.8%.

P: 0.015% or Less

P is an element which causes grain boundary embrittlement by being segregated in grain boundaries and locally hardens steel by being segregated therein. In embodiments of the present invention, P is an unavoidable impurity. Therefore, it is preferable that the P content is reduced as much as possible. However, a P content of 0.015% or less is allowable. Therefore, the P content is limited to be 0.015% or less. Preferably, the P content is 0.012% or less.

S: 0.005% or Less

S is an unavoidable impurity, is present in steel as a sulfide-based inclusion in many cases, and deteriorates ductility, toughness, and SSC resistance. Therefore, it is preferable that the S content is reduced as much as possible. However, a S content of 0.005% or less is allowable. Therefore, the S content is limited to be 0.005% or less. Preferably, the S content is 0.003% or less.

Al: 0.005% to 0.1%

Al functions as a deoxidizing agent and contributes to the refining of austenite grains during heating by being bonded with N to form AlN. In addition, Al fixes N, prevents bonding of solid solution B with N, and suppresses a decrease in the effect of B improving the hardenability. In order to obtain the above-described effects, the Al content is necessarily 0.005% or more. On the other hand, the addition of more than 0.1% of Al causes an increase in the number of oxide-based inclusions, deteriorates the cleanliness of steel, and causes a deterioration in ductility, toughness, and SSC resistance. Therefore, the Al content is limited to a range of 0.005% to 0.1%. Preferably, the Al content is 0.01% to 0.08%. More preferably, the Al content is 0.02% to 0.05%.

N: 0.006% or Less

N is present in steel as an unavoidable impurity. However, N has an effect of refining crystal grains and improving toughness when being bonded with Al to form AlN or, in a case where Ti is contained, when being bonded with Ti to form TiN. However, the addition of more than 0.006% of N coarsens nitrides to be formed and significantly deteriorates SSC resistance and toughness. Therefore, the N content is limited to be 0.006% or less.

Mo: More than 1.0% and 3.0% or Less

Mo is an element which forms a carbide and contributes to strengthening of steel through precipitation strengthening. Mo effectively contributes to securement of desired high strength after reduction in dislocation density by tempering. Due to the reduction in dislocation density, SSC resistance is improved. In addition, Mo contributes to improvement of SSC resistance by being solid-solubilized in steel and segregated in prior austenite grain boundaries. Further, Mo has an effect of densifying a corrosion product and suppressing the formation and growth of a pit which causes cracking. In order to obtain the above-described effects, the Mo content is necessarily more than 1.0%. On the other hand, the addition of more than 3.0% of Mo promotes the formation of a needle-like $M_2C$ precipitate or, in some cases, a Laves phase ($Fe_2Mo$) and deteriorates SSC resistance. Therefore, the Mo content is limited to a range of more than 1.0% and 3.0% or less. The Mo content is preferably 1.45% to 2.5%.

V: 0.01% or More and Less than 0.05%

V is an element which forms a carbide or a carbon-nitride and contributes to strengthening of steel. In order to obtain the above-described effects, the V content is necessarily 0.01% or more. On the other hand, when the V content is more than 0.05%, the effect is saturated, and an effect corresponding to the content cannot be expected, which is economically disadvantageous. Therefore, the V content is limited to a range of 0.01% or more and less than 0.05%.

Nb: 0.001% or More and Less than 0.01%

Nb forms a carbide or a carbon-nitride, contributes to an increase in the strength of steel through precipitation strengthening, and also contributes to the refining of austenite grains. In order to obtain the above-described effects, the Nb content is necessarily 0.001% or more. On the other hand, a Nb precipitate is likely to function as a propagation path of SSC (sulfide stress cracking), and the presence of a large amount of Nb precipitate based on the addition of a large amount of 0.01% or more of Nb leads to a significant deterioration in SSC resistance, particularly, in high-strength steel having a yield strength of 125 ksi or higher. Therefore, in embodiments of the present invention, the Nb content is limited to a range of 0.001% or more and less than 0.01% from the viewpoint of simultaneously realizing desired high strength and superior SSC resistance.

B: 0.0003% to 0.0030%

B is segregated in austenite grain boundaries and suppresses ferrite transformation in the grain boundaries. As a result, even with a small amount of addition of B, an effect of improving the hardenability of steel can be obtained. In order to obtain the above-described effects, the B content is necessarily 0.0003% or more. On the other hand, when the B content is more than 0.0030%, B is precipitated as a carbon-nitride or the like, which deteriorates hardenability and toughness. Therefore, the B content is limited to a range of 0.0003% to 0.0030%. Preferably, the B content is 0.0007% to 0.0025%.

O (Oxygen): 0.0030% or Less

O (oxygen) is an unavoidable impurity and is present in steel as an oxide-based inclusion. This inclusion causes SSC and deteriorates SSC resistance. Therefore, in embodiments of the present invention, it is preferable that the O (oxygen) content is reduced as much as possible. However, excessive reduction of O (oxygen) causes an increase in refining cost, and thus an O content of 0.0030% or less is allowable. Therefore, the O (oxygen) content is limited to be 0.0030% or less. Preferably, the O (oxygen) content is 0.0020% or less.

Ti: 0.003% to 0.025%

Ti is precipitated as fine TiN by being bonded with N during the solidification of molten steel and, due to the pinning effect thereof, contributes to the refining of austenite grains. In order to obtain the above-described effects, the Ti content is necessarily 0.003% or more. When the TI content is less than 0.003%, the effect is low. On the other hand, when the Ti content is more than 0.025%, TiN is coarsened, the above-described pinning effect cannot be exhibited, and toughness deteriorates. In addition, coarse TiN causes a deterioration in SSC resistance. Therefore, the Ti content is limited to a range of 0.003% to 0.025%.

Ti/N: 2.0 to 5.0

When Ti/N is less than 2.0, the fixing of N is insufficient, BN is formed, and the effect of B improving hardenability decreases. On the other hand, when Ti/N is more than 5.0, TiN is more likely to be coarsened, and toughness and SSC resistance deteriorate. Therefore, Ti/N is limited to a range of 2.0% to 5.0%. Preferably, Ti/N is 2.5% to 4.5%.

The above-described elements are basic elements. In addition to the basic composition, the high-strength seamless steel pipe according to embodiments of the present invention may further contain one element or more elements of Cr: 0.6% or less, Cu: 1.0% or less, Ni: 1.0% or less, and W: 3.0% or less and/or Ca: 0.0005% to 0.0050% as optional elements.

One Element or More Elements of Cr: 0.6% or Less, Cu: 1.0% or Less, Ni: 1.0% or Less, and W: 3.0% or Less Cr, Cu, Ni, and W are elements which contribute to an increase in the strength of steel, and one element or more elements selected from these elements can be optionally contained.

Cr is an element which increases the strength of steel by improving hardenability and improves corrosion resistance. In addition, Cr is an element which is bonded with C to form a carbide such as $M_3C$, $M_7C_3$, or $M_{23}C_6$(M represents a metal element) during a tempering treatment and improves tempering softening resistance and is an element required. In order to obtain the above-described effects, the Cr content is necessarily more than 0.10% or more. On the other hand, when the Cr content is more than 0.6%, a large amount of $M_7C_3$ or $M_{23}C_6$ is formed and functions as a trap site for hydrogen to deteriorate SSC resistance. Therefore, in case of containing Cr, the Cr content is limited to a range of 0.6% or less.

Cu is an element which contributes to an increase in the strength of steel and has an effect of improving toughness and corrosion resistance. In particular, Cu is extremely effective for improving SSC resistance in a severe corrosive environment. When Cu is contained, corrosion resistance is improved by a dense corrosion product being formed, and the formation and growth of a pit which causes cracking is suppressed. In order to obtain the above-described effects, the Cu content is preferably 0.03% or more. On the other hand, when the Cu content is more than 1.0%, the effect is saturated, and an effect corresponding to the content cannot be expected, which is economically disadvantageous. Therefore, when Cu is contained, it is preferable that the Cu content is limited to be 1.0% or less.

Ni is an element which contributes to an increase in the strength of steel and improves toughness and corrosion resistance. In order to obtain the above-described effects, the Ni content is preferably 0.03% or more. On the other hand, when the Ni content is more than 1.0%, the effect is saturated, and an effect corresponding to the content cannot be expected, which is economically disadvantageous. Therefore, when Ni is contained, it is preferable that the Ni content is limited to be 1.0% or less.

W is an element which forms a carbide, contributes to an increase in the strength of steel through precipitation strengthening, and also contributes to improvement of SSC resistance by being solid-solubilized and segregated in prior austenite grain boundaries. In order to obtain the above-described effects, the W content is preferably 0.03% or more. On the other hand, when the W content is more than 3.0%, the effect is saturated, and an effect corresponding to the content cannot be expected, which is economically disadvantageous. Therefore, when W is contained, it is preferable that the W content is limited to be 3.0% or less.

Ca: 0.0005% to 0.0050%

Ca is an element which is bonded with S to form CaS and efficiently serves to control the form of sulfide-based inclusions, and contributes to improvement of toughness and SSC resistance by controlling the form of sulfide-based inclusions. In order to obtain the above-described effects, the Ca content is 0.0005% or more. On the other hand, when the Ca content is more than 0.0050%, the effect is saturated, and an effect corresponding to the content cannot be expected, which is economically disadvantageous. Therefore, when Ca is contained, it is preferable that the Ca content is limited to a range of 0.0005% to 0.0050%.

A remainder other than the above-described components includes Fe and unavoidable impurities. As the unavoidable impurities, Mg: 0.0008% or less and Co: 0.05% or less are allowable.

The high-strength seamless steel pipe according to embodiments of the present invention contains the above-described composition, in which tempered martensite is a main phase and has a volume fraction of 95% or more, prior austenite grains have a grain size number of 8.5 or more, and in a cross-section perpendicular to a rolling direction, the number of nitride-based inclusions having a grain size of 4 μm or more is 100 or less per 100 $mm^2$, the number of nitride-based inclusions having a grain size of less than 4 μm is 1000 or less per 100 $mm^2$, the number of oxide-based inclusions having a grain size of 4 μm or more is 40 or less per 100 $mm^2$, and the number of oxide-based inclusions having a grain size of less than 4 μm is 400 or less per 100 $mm^2$.

Tempered Martensitic Phase: 95% or More

In the high strength seamless steel pipe according to embodiments of the present invention, to acquire a high strength of 125 ksi class or more YS with certainty and to maintain ductility and toughness necessary for the steel pipe as a construction, a tempered martensitic phase formed by tempering the martensitic phase is set as a main phase. The "main phase" described herein represents a case where this phase is a single phase having a volume fraction of 100% or a case where this phase is contained in the microstructure at a volume fraction of 95% or more and a second phase is contained in the microstructure at a volume fraction of 5% or less that range does not affect characteristics of the microstructure. In embodiments of the present invention, examples of the second phase include bainite, remaining austenite, pearlite, and a mixed phase thereof.

In the high-strength seamless steel pipe according to embodiments of the present invention, the above-described composition can be adjusted by appropriately selecting a heating temperature during a quenching treatment and a cooling rate during cooling according to the components of steel.

Grain Size Number of Prior Austenite Grains: 8.5 or More

When the grain size number of prior austenite grains is less than 8.5, a lower microstructure of martensite to be formed is coarsened, SSC resistance deteriorates. Therefore, the grain size number of prior austenite grains is limited to be 8.5 or more. As the grain size number, a value measured according to JIS G 0551 is used.

In embodiments of the present invention, the grain size number of prior austenite grains can be adjusted by changing a heating rate, a heating temperature, and a holding temperature during a quenching treatment and changing the number of times of the quenching treatment.

Further, in the high-strength seamless steel pipe according to embodiments of the present invention, in order to improve SSC resistance, the numbers of nitride-based inclusions and oxide-based inclusions are adjusted to be in appropriate ranges depending on the sizes. Nitride-based inclusions and oxide-based inclusions are identified by automatic detection using a scanning electron microscope. The nitride-based inclusions contain Ti and Nb as major components, and the oxide-based inclusions contain Al, Ca, Mg as major components. The numbers of the inclusions are values measured in a cross-section perpendicular to a rolling direction of the steel pipe (cross-section perpendicular to a pipe axis direction: C cross-section). As the sizes of the inclusions, grain sizes of the respective inclusions are used. Regarding the grain sizes of the inclusions, the areas of inclusion grains are obtained, and circle equivalent diameters thereof are calculated to obtain the grain sizes of the inclusion grains.

Number of Nitride-Based Inclusions Having Grain Size of 4 μm or More: 100 or Less Per 100 $mm^2$ Nitride-based inclusions causes SSC in the high-strength steel pipe having a yield strength of 125 ksi or higher, and as the size thereof increases to be 4 μm or more, an adverse effect thereof increases. Therefore, it is preferable that the number of nitride-based inclusions having a grain size of 4 μm or more decreases as much as possible. However, when the number of nitride-based inclusions having a grain size of 4 μm or more is 100 or less per 100 $mm^2$, an adverse effect on SSC resistance is allowable. Therefore, the number of nitride-based inclusions having a grain size of 4 μm or more is limited to be 100 or less per 100 $mm^2$. Preferably, the number of nitride-based inclusions having a grain size of 4 μm or more is 84 or less.

Number of Nitride-Based Inclusions Having Grain Size of Less than 4 μm: 1000 or Less Per 100 $mm^2$ The presence of a single fine nitride-based inclusions having a grain size of less than 4 μm does not cause SSC. However, in the high-strength steel pipe having a yield strength YS of 125 ksi or higher, when the number of nitride-based inclusions having a grain size of less than 4 μm is more than 1000 per 100 $mm^2$, an adverse effect thereof on SSC resistance is not allowable. Therefore, the number of nitride-based inclusions having a grain size of less than 4 μm is limited to be 1000 or less per 100 $mm^2$. Preferably, the number of nitride-based inclusions having a grain size of less than 4 μm is 900 or less.

Number of Oxide-Based Inclusions Having Grain Size of 4 μm or More: 40 or Less Per 100 $mm^2$ Oxide-based inclusions causes SSC in the high-strength steel pipe having a yield strength YS of 125 ksi or higher, and as the size thereof increases to be 4 μm or more, an adverse effect thereof increases. Therefore, it is preferable that the number of oxide-based inclusions having a grain size of 4 μm or more decreases as much as possible. However, when the number of oxide-based inclusions having a grain size of 4 μm or more is 40 or less per 100 $mm^2$, an adverse effect thereof on SSC resistance is allowable. Therefore, the number of oxide-based inclusions having a grain size of 4 μm or more is limited to be 40 or less per 100 $mm^2$. Preferably, the number of oxide-based inclusions having a grain size of 4 μm or more is 35 or less.

Number of Oxide-Based Inclusions Having Grain Size of Less than 4 μm: 400 or Less Per 100 $mm^2$ Even a small oxide-based inclusion having a grain size of less than 4 μm causes SSC in the high-strength steel pipe having a yield strength of 125 ksi or higher, and as the number thereof increases, an adverse effect thereof on SSC resistance increases. Therefore, it is preferable that the number of oxide-based inclusions having a grain size of less than 4 μm decreases as much as possible. However, when the number of oxide-based inclusions having a grain size of less than 4 μm is 400 or less per 100 $mm^2$, an adverse effect thereof on SSC resistance is allowable. Therefore, the number of oxide-based inclusions having a grain size of less than 4 μm is limited to be 400 or less per 100 $mm^2$. Preferably, the number of oxide-based inclusions having a grain size of less than 4 μm is 365 or less.

In embodiments of the present invention, in order to adjust the numbers of nitride-based inclusions and oxide-based inclusions, in particular, control in a refining process of molten steel is important. Desulfurization and dephosphorization are performed in a molten iron preparation treatment, decarburization and dephosphorization are performed in a steelmaking converter, and then a heating-stirring-refining treatment (LF) and a RH vacuum degassing treatment are performed in a ladle. The treatment time of the heating-stirring-refining treatment (LF) is sufficiently secured. In addition, the treatment time of the RH vacuum degassing treatment is secured. In addition, in order to prepare a cast slab (steel pipe raw material) using a continuous casting method, the molten steel is cast from the ladle into a tundish such that the numbers of nitride-based inclusions and oxide-based inclusions per unit area are the above-described values or less, and the molten steel is sealed using inert gas. In addition, the molten steel is electromagnetically stirred in a mold to separate inclusions by flotation.

Next, a preferable method of producing a high-strength seamless steel pipe according embodiments of to the present invention will be described.

In embodiments of the present invention, the steel pipe raw material having the above-described composition is heated, and hot working is performed on the heated steel pipe raw material to form a seamless steel pipe having a predetermined shape.

It is preferable that the steel pipe raw material used in embodiments of the present invention is prepared by preparing molten steel having the above-described composition with a commonly-used melting method using a steel making converter or the like and obtaining a cast slab (round cast slab) using a commonly-used casting method such as a continuous casting method. Further, the cast slab may be hot-rolled into a round steel slab having a predetermined shape or may undergo ingot making and blooming to obtain a round steel slab.

In the high-strength seamless steel pipe according to embodiments of the present invention, in order to further improve SSC resistance, the numbers of nitride-based inclusions and oxide-based inclusions per unit area are reduced to be the above-described values or less. Therefore, in the steel pipe raw material (cast slab or steel slab), it is necessary to reduce the N content and the O content as much as possible so as to satisfy the ranges of N (nitrogen): 0.006% or less and O (oxygen): 0.0030% or less.

In order to adjust the numbers of nitride-based inclusions and oxide-based inclusions per unit area to be the above-described values or less, control in the refining process of molten steel is important. In embodiments of the present invention, it is preferable to perform desulfurization and dephosphorization in a molten iron preparation treatment, to perform decarburization and dephosphorization in a steel making converter, and then to perform a heating-stirring-refining treatment (LF) and a RH vacuum degassing treatment in a ladle. As the LF time increases, the CaO concentration or the CaS concentration in the inclusions decreases, $MgO—Al_2O_3$ inclusions are formed, and SSC resistance is improved. In addition, when the RH time increases, the oxygen concentration in the molten steel decreases, the size of the oxide-based inclusions decreases, and the number thereof decreases. Therefore, it is preferable that the treatment time of the heating-stirring-refining treatment (LF) is 30 minutes or longer, the treatment time of the RH vacuum degassing treatment is 20 minutes or longer.

In addition, in order to prepare a cast slab (steel pipe raw material) using a continuous casting method, it is preferable that the molten steel is cast from the ladle into a tundish such that the numbers of nitride-based inclusions and oxide-based inclusions per unit area are the above-described values or less, and the molten steel is sealed using inert gas. In addition, it is preferable that the molten steel is electromagnetically stirred in a mold to separate inclusions by flotation. As a result, the amounts and sizes of nitride-based inclusions and oxygen-based inclusions can be adjusted.

Next, the cast slab is heated to a heating temperature of 1050° C. to 1350° C., and hot working is performed on the cast slab (steel pipe raw material) having the above-described composition to form a seamless steel pipe having a predetermined dimension.

Heating Temperature: 1050° C. to 1350° C.

When the heating temperature is lower than 1050° C., the melting of carbides in the steel pipe raw material is insufficient. On the other hand, when the cast slab is heated to higher than 1350° C., crystal grains are coarsened, precipitates such as TiN precipitated during solidification are coarsened, and cementite is coarsened. As a result, the toughness of the steel pipe deteriorates. In addition, the cast slab is heated to a high temperature of higher than 1350° C., a thick scale layer is formed on the surface of the steel pipe raw material, which causes surface defects to be generated during rolling. In addition, the energy loss increases, which is not preferable from the viewpoint of energy saving. Therefore, the heating temperature is limited to be in a range of 1050° C. to 1350° C. Preferably, the heating temperature is in a range of 1100° C. to 1300° C.

Next, hot working (pipe making) is performed on the heated steel pipe raw material using a hot rolling mill of the Mannesmann-plug mill process or the Mannesmann-mandrel mill process to form a seamless steel pipe having a predetermined dimension. The seamless steel pipe may be obtained by hot extrusion using a pressing process.

After the completion of the hot working, a cooling treatment is performed on the obtained seamless steel pipe in which the seamless steel pipe is cooled at a cooling rate equal to or higher than that of air cooling until a surface temperature thereof reaches 200° C. or lower.

Cooling Treatment after Completion of Hot Working: Cooling Rate: Air Cooling Rate or Higher, Cooling Stop Temperature: 200° C. or Lower When the seamless steel pipe in the composition range according to embodiments of the present invention is cooled at a cooling rate equal to or higher than that of air cooling after the hot working, a microstructure containing martensite as a main phase can be obtained. When air cooling (cooling) is stopped at a surface temperature of higher than 200° C., the transformation may not be fully completed. Therefore, after the hot working, the seamless steel pipe is cooled at a cooling rate equal to or higher than that of air cooling until the surface temperature thereof reaches 200° C. or lower. In addition, in embodiments of the present invention, "the cooling rate equal to or higher than that of air cooling" represents 0.1° C./sec. or higher. When the cooling rate is lower than 0.1° C./sec. a metallographic microstructure after the cooling is non-uniform, and a metallographic microstructure after a heat treatment subsequent to the cooling is non-uniform.

After the cooling treatment of cooling the seamless steel pipe at a cooling rate equal to or higher than that of air cooling, a tempering treatment is performed. In the tempering treatment, the seamless steel pipe is heated at a temperature in a range of 600° C. to 740° C.

Tempering Temperature: 600° C. to 740° C.

The tempering treatment is performed in order to decrease the dislocation density to improve toughness and SSC resistance. When the tempering temperature is lower than 600° C., a decrease in dislocation is insufficient, and thus superior SSC resistance cannot be secured. On the other hand, when the tempering temperature is higher than 740° C., the softening of the microstructure becomes severe, and desired high strength cannot be secured. Therefore, the tempering temperature is limited to a temperature in a range of 600° C. to 740° C. Preferably, the tempering temperature is in a range of 670° C. to 710° C.

In order to stably secure desired characteristics, after the hot working and the cooling treatment of cooling the seamless steel pipe at a cooling rate equal to or higher than that of air cooling, a quenching treatment is performed in which the seamless steel pipe is reheated and rapidly cooled by water cooling or the like. Next, the above-described tempering treatment is performed.

Reheating Temperature During Quenching Treatment: From $Ac_3$ Transformation Point to 1000° C.

When the reheating temperature is lower than an $Ac_3$ transformation point, the seamless steel pipe is not heated to an austenite single-phase region. Therefore, a microstructure containing martensite as a main phase cannot be obtained. On the other hand, when the reheating temperature is higher than 1000° C., there are various adverse effects. For example, crystal grains are coarsened, toughness deteriorates, the thickness of oxide scale on the surface increases, and peeling is likely to occur, which causes defects to be generated on the surface of the steel pipe. Further, an excess amount of load is applied to a heat treatment furnace, which causes a problem from the viewpoint of energy saving. Therefore, from the viewpoint of energy saving, the reheating temperature during the quenching treatment is limited to a range of an $Ac_3$ transformation point to 1000° C. Preferably, the reheating temperature during the quenching treatment is 950° C. or lower.

In addition, in the quenching treatment, it is preferable that the cooling after reheating is performed by water cooling at an average cooling rate of 2° C./sec. until the temperature at a wall thickness center position reaches 400°

C. or lower, and then is performed until the surface temperature reaches 200° C. or lower and preferably 100° C. or lower. The quenching treatment may be repeated twice or more.

As the $Ac_3$ transformation point, a value calculated from the following equation can be used.

$$Ac_3 \text{ transformation point } (^\circ \text{ C.}) = 937 - 476.5C + 56Si - 19.7Mn - 16.3Cu - 4.9Cr - 26.6Ni + 38.1Mo + 124.8V + 136.3Ti + 198Al + 3315B$$

(wherein C, Si, Mn, Cu, Cr, Ni, Mo, V, Ti, Al, B: content (mass %) of each element)

In the calculation of the $Ac_3$ transformation point, when an element shown in the above-described equation is not contained, the content of the element is calculated as 0%.

After the tempering treatment or the quenching treatment, optionally, a correction treatment of correcting shape defects of the steel pipe may be performed in a warm or cool environment.

Embodiment

Hereinafter, aspects of the present invention will be described in more detail based on the following Embodiment.

Regarding molten iron tapped from a blast furnace, desulfurization and dephosphorization were performed in a molten iron preparation treatment, decarburization and dephosphorization were performed in a steel making converter, a heating-stirring-refining treatment (LF) was performed under conditions of a treatment time of 60 minutes as shown in Table 2, and a RH vacuum degassing treatment was performed under conditions of a reflux amount of 120 ton/min and a treatment time of 10 minutes to 40 minutes. As a result, molten steel having a composition shown in Table 1 was obtained, and a cast slab (round cast slab: 190 mmϕ) was obtained using a continuous casting method. In the continuous casting method, Ar gas shielding in a tundish were performed except for Steel No. P and No. S and electromagnetic stirring in a mold were performed except for Steel No. N and No. S.

The obtained cast slab was charged into a heating furnace as a steel pipe raw material, was heated to a heating temperature shown in Table 2, and was held at this temperature (holding time: 2 hours). Hot working was performed on the heated steel pipe raw material using a hot rolling mill of the Mannesmann-plug mill process to form a seamless steel pipe (outer diameter 100 mm to 230 mmϕ× wall thickness 12 mm to 30 mm). After the hot working, air cooling was performed, and quenching and tempering treatments were performed under conditions shown in Table 2. Regarding a part of the seamless steel pipes, after the hot working, water cooling was performed, and then a tempering treatment or quenching and tempering treatments were performed.

A specimen was collected from each of the obtained seamless steel pipes, and microstructure observation, a tensile test, and a sulfide stress cracking test were performed. Test methods were as follows.

(1) Microstructure Observation

A specimen for microstructure observation was collected from an inner surface-side ¼ t position (t: wall thickness) of each of the obtained seamless steel pipes. A cross-section (C cross-section) perpendicular to a pipe longitudinal direction was polished and was corroded (Nital (nitric acid-ethanol mixed solution) corrosion) to expose a microstructure. The exposed microstructure was observed and imaged using an optical microscope (magnification: 1000 times) and a scanning electron microscope (magnification: 2000 times to 3000 times) in four or more fields of view. By analyzing the obtained microstructure images, phases constituting the microstructure were identified, and a ratio of the phases in the microstructure were calculated.

In addition, using the specimen for microstructure observation, the grain sizes of prior austenite (γ) grains were measured. The cross-section (C cross-section) of the specimen for microstructure observation perpendicular to the pipe longitudinal direction was polished and was corroded (with Picral solution (picric acid-ethanol mixed solution) to expose prior γ grain boundaries. The exposed prior γ grain boundaries were observed and imaged using an optical microscope (magnification: 1000 times) in three or more fields of view. From the obtained microstructure images, the grain size number of prior γ grains was obtained using a cutting method according to JIS G 0551.

In addition, regarding the specimen for microstructure observation, the microstructure in a region having a size of 400 $mm^2$ was observed using a scanning electron microscope (magnification: 2000 times to 3000 times). Inclusions were automatically detected based on the light and shade of the images. Concurrently, the quantitative analysis of the inclusions was automatically performed using an EDX (energy dispersive X-ray analysis) provided in the scanning electron microscope to measure the kinds, sizes, and numbers of the inclusions. The kinds of the inclusions were determined based on the quantitative analysis using the EDX. The inclusions were classified into nitride-based inclusions containing Ti and Nb as major components and oxide-based inclusions containing Al, Ca, and Mg as major components. "Major component" described herein represents a case where the content of the element is 65% or more in total.

In addition, the numbers of grains identified as inclusions were obtained. Further, the areas of the respective grains were obtained, and circle equivalent diameters thereof were calculated to obtain the grain sizes of the inclusions. The number densities (grains/100 $mm^2$) of inclusions having a grain size of 4 μm or more and inclusions having a grain size of less than 4 μm were calculated. Inclusions having a long side length of shorter than 2 μm were not analyzed.

(2) Tensile Test

JIS No. 10 specimen for a tensile test (bar specimen: diameter of parallel portion: 12.5 mmϕ, length of parallel portion: 60 mm, GL (Gage Length): 50 mm) was collected from an inner surface-side ¼ t position (t: wall thickness) of each of the obtained seamless steel pipes according to JIS Z 2241 such that a tensile direction was a pipe axis direction. Using this specimen, the tensile test was performed to obtain tensile characteristics (yield strength YS (0.5% yield strength), tensile strength TS).

(3) Sulfide Stress Cracking Test

A specimen for a tensile test (diameter of parallel portion: 6.35 mmϕ×length of parallel portion: 25.4 mm) was collected centering on an inner surface-side ¼ t position (t: wall thickness) of each of the obtained seamless steel pipes such that a pipe axis direction was a tensile direction.

Using the obtained specimen for a tensile test, a sulfide stress cracking test was performed according to a test method defined in NACE TMO177 Method A. The sulfide stress cracking test was a constant-load test in which the above-described specimen for a tensile test was dipped in a test solution (an acetic acid-sodium acetate solution (liquid temperature: 24° C.) saturated with hydrogen sulfide at 10 kPa, having an adjusted pH of 3.5, and containing 5.0 mass % of sodium chloride solution) and was held with an applied load of 85% of yield strength YS. The evaluation "○: good" (satisfactory) was given to cases where the specimen was not broken before 720 hours, and the evaluation "x: bad" (unsatisfactory) was given to other cases where the specimen was broken before 720 hours). When a target yield strength was not secured, the sulfide stress cracking test was not performed.

The obtained results are shown in Table 3.

TABLE 1

| Steel No. | Elements composition (mass %) | | | | | | | | | | |
|---|---|---|---|---|---|---|---|---|---|---|---|
| | C | Si | Mn | P | S | Al | N | Mo | V | Nb | B |
| A | 0.27 | 0.27 | 0.74 | 0.008 | 0.0015 | 0.040 | 0.0018 | 1.56 | 0.04 | 0.009 | 0.0019 |
| B | 0.32 | 0.26 | 0.65 | 0.008 | 0.0013 | 0.035 | 0.0049 | 2.12 | 0.04 | 0.008 | 0.0020 |
| C | 0.33 | 0.30 | 0.41 | 0.008 | 0.0012 | 0.025 | 0.0054 | 1.65 | 0.04 | 0.008 | 0.0015 |
| D | 0.29 | 0.24 | 0.39 | 0.010 | 0.0012 | 0.033 | 0.0058 | 1.86 | 0.04 | 0.002 | 0.0012 |
| E | 0.31 | 0.26 | 0.45 | 0.011 | 0.0012 | 0.035 | 0.0042 | 1.67 | 0.02 | 0.008 | 0.0017 |
| F | 0.32 | 0.13 | 0.54 | 0.011 | 0.0014 | 0.024 | 0.0036 | 1.26 | 0.03 | 0.007 | 0.0022 |
| G | 0.19 | 0.35 | 0.66 | 0.012 | 0.0015 | 0.026 | 0.0033 | 1.42 | 0.03 | 0.008 | 0.0014 |
| H | 0.55 | 0.16 | 0.33 | 0.012 | 0.0012 | 0.022 | 0.0035 | 1.57 | 0.03 | 0.007 | 0.0023 |
| I | 0.28 | 0.33 | 0.47 | 0.013 | 0.0013 | 0.026 | 0.0042 | 0.89 | 0.02 | 0.008 | 0.0024 |
| J | 0.28 | 0.27 | 0.44 | 0.013 | 0.0012 | 0.034 | 0.0046 | 1.81 | 0.04 | 0.006 | 0.0018 |
| K | 0.32 | 0.25 | 0.55 | 0.011 | 0.0011 | 0.035 | 0.0056 | 1.70 | 0.03 | 0.016 | 0.0017 |
| L | 0.34 | 0.26 | 0.70 | 0.009 | 0.0017 | 0.036 | 0.0039 | 1.65 | 0.03 | 0.007 | 0.0021 |
| M | 0.31 | 0.29 | 0.36 | 0.012 | 0.0008 | 0.036 | 0.0069 | 1.65 | 0.03 | 0.008 | 0.0010 |
| N | 0.30 | 0.32 | 0.70 | 0.010 | 0.0015 | 0.037 | 0.0036 | 1.95 | 0.03 | 0.007 | 0.0019 |
| O | 0.29 | 0.33 | 0.61 | 0.009 | 0.0012 | 0.033 | 0.0056 | 1.50 | 0.04 | 0.007 | 0.0015 |
| P | 0.29 | 0.28 | 0.66 | 0.009 | 0.0009 | 0.022 | 0.0075 | 1.15 | 0.04 | 0.008 | 0.0015 |
| Q | 0.34 | 0.25 | 0.54 | 0.009 | 0.0012 | 0.035 | 0.0057 | 1.65 | 0.07 | 0.008 | 0.0015 |
| R | 0.26 | 0.24 | 0.55 | 0.010 | 0.0009 | 0.033 | 0.0033 | 1.55 | 0.03 | 0.007 | 0.0022 |
| S | 0.32 | 0.33 | 0.46 | 0.012 | 0.0009 | 0.032 | 0.0046 | 1.29 | 0.03 | 0.008 | 0.0018 |

| Steel No. | Elements composition (mass %) | | | | | |
|---|---|---|---|---|---|---|
| | Ti | Cr, Cu, Ni, W | Ca | O | Ti/N | Note |
| A | 0.006 | Cr: 0.02, | — | 0.0015 | 3.3 | Suitable Example |
| B | 0.021 | Cr: 0.55, Ni: 0.15 | — | 0.0011 | 4.3 | Suitable Example |
| C | 0.019 | Cr: 0.42 | 0.0010 | 0.0012 | 3.5 | Suitable Example |
| D | 0.024 | Cr: 0.31, Cu: 0.70 | — | 0.0009 | 4.1 | Suitable Example |
| E | 0.011 | Cr: 0.56, Cu: 0.42, Ni: 0.21 | 0.0015 | 0.0009 | 2.6 | Suitable Example |
| F | 0.016 | Cr: 0.25, W: 1.55 | — | 0.0008 | 4.4 | Suitable Example |
| G | 0.012 | Cr: 0.30, Ni: 0.22 | 0.0015 | 0.0016 | 3.6 | Comparative Example |
| H | 0.011 | Cr: 0.45 | — | 0.0012 | 3.1 | Comparative Example |
| I | 0.012 | Cr: 0.34 | — | 0.0008 | 2.9 | Comparative Example |
| J | 0.012 | Cr: 0.72 | — | 0.0009 | 2.6 | Comparative Example |
| K | 0.022 | Cr: 0.33 | — | 0.0009 | 3.9 | Comparative Example |
| L | 0.022 | Cr: 0.45, Cu: 0.22 | — | 0.0012 | 5.6 | Comparative Example |
| M | 0.013 | Cr: 0.29, Cu: 0.12, Ni: 0.14 | 0.0022 | 0.0017 | 1.9 | Comparative Example |
| N | 0.015 | Cr: 0.25, Cu: 0.33 | 0.0025 | 0.0032 | 4.2 | Comparative Example |
| O | 0.027 | Cr: 0.26 | — | 0.0014 | 4.8 | Comparative Example |
| P | 0.020 | Cr: 0.56 | — | 0.0036 | 2.7 | Comparative Example |
| Q | 0.024 | Cr: 0.36 | — | 0.0011 | 4.2 | Comparative Example |
| R | 0.013 | — | — | 0.0012 | 3.9 | Suitable Example |
| S | 0.021 | — | — | 0.0013 | 4.6 | Suitable Example |

TABLE 2

| Steel Pipe No. | Steel No. | Refining Treatment Time (min)***** LF | RH | Casting Sealing ****** | Casting Electromagnetic Stirring ******* | Heating Heating Temperature (° C.) | Pipe Dimension Outer Diameter (mmφ) | Pipe Dimension Wall thickness (mm) | Cooling after Hot Working Cooling | Cooling after Hot Working Cooling Stop Temperature* (° C.) |
|---|---|---|---|---|---|---|---|---|---|---|
| 1 | A | 50 | 20 | ○ | ○ | 1200 | 160 | 19 | Air Cooling | ≤100 |
| 2 | A | 50 | 20 | ○ | ○ | 1200 | 200 | 25 | Air Cooling | ≤100 |
| 3 | B | 60 | 30 | ○ | ○ | 1200 | 160 | 19 | Air Cooling | ≤100 |
| 4 | B | 60 | 30 | ○ | ○ | 1200 | 100 | 12 | Air Cooling | ≤100 |
| 5 | B | 60 | 30 | ○ | ○ | 1100 | 160 | 19 | Water Cooling | 200 |
| 6 | B | 60 | 30 | ○ | ○ | 1200 | 160 | 19 | Water Cooling | 200 |
| 7 | B | 60 | 30 | ○ | ○ | 1200 | 200 | 25 | Air Cooling | ≤100 |
| 8 | C | 45 | 40 | ○ | ○ | 1200 | 160 | 19 | Air Cooling | ≤100 |
| 9 | C | 45 | 40 | ○ | ○ | 1200 | 160 | 19 | Air Cooling | ≤100 |
| 10 | D | 50 | 40 | ○ | ○ | 1200 | 160 | 19 | Air Cooling | ≤100 |
| 11 | E | 50 | 30 | ○ | ○ | 1200 | 160 | 19 | Air Cooling | ≤100 |
| 12 | E | 50 | 30 | ○ | ○ | 1200 | 160 | 19 | Air Cooling | ≤100 |

TABLE 2-continued

| | | | | | | | | | | |
|---|---|---|---|---|---|---|---|---|---|---|
| 13 | E | 50 | 30 | ○ | ○ | 1200 | 160 | 19 | Air Cooling | ≤100 |
| 14 | F | 60 | 30 | ○ | ○ | 1200 | 160 | 19 | Air Cooling | ≤100 |
| 16 | G | 30 | 30 | ○ | ○ | 1200 | 160 | 19 | Air Cooling | ≤100 |
| 17 | H | 40 | 30 | ○ | ○ | 1200 | 160 | 19 | Air Cooling | ≤100 |
| 18 | I | 40 | 30 | ○ | ○ | 1200 | 160 | 19 | Air Cooling | ≤100 |
| 19 | J | 40 | 30 | ○ | ○ | 1200 | 160 | 19 | Air Cooling | ≤100 |
| 20 | K | 40 | 30 | ○ | ○ | 1200 | 160 | 19 | Air Cooling | ≤100 |
| 21 | L | 40 | 30 | ○ | ○ | 1200 | 160 | 19 | Air Cooling | ≤100 |
| 22 | M | 40 | 30 | ○ | ○ | 1200 | 160 | 19 | Air Cooling | ≤100 |
| 23 | N | 30 | 10 | ○ | X | 1200 | 160 | 19 | Air Cooling | ≤100 |
| 24 | O | 30 | 10 | ○ | ○ | 1200 | 160 | 19 | Air Cooling | ≤100 |
| 25 | P | 30 | 30 | X | ○ | 1200 | 160 | 19 | Air Cooling | ≤100 |
| 26 | Q | 60 | 30 | ○ | ○ | 1200 | 160 | 19 | Air Cooling | ≤100 |
| 27 | R | 50 | 25 | ○ | ○ | 1200 | 160 | 25 | Air Cooling | ≤100 |
| 28 | S | 50 | 30 | X | X | 1200 | 230 | 30 | Air Cooling | ≤100 |
| 29 | E | 50 | 20 | ○ | ○ | 1250 | 160 | 12 | Air Cooling | ≤100 |

| | Quenching Treatment | | Tempering | | |
|---|---|---|---|---|---|
| Steel Pipe No. | Quenching Temperature** (° C.) | Cooling Stop Temperature*** (° C.) | Treatment Tempering Temperature (° C.) | $Ac_3$ Transformation Point (° C.) | Note |
| 1 | 920 | 150 | 680 | 888 | Example |
| 2 | 920 | 150 | 680 | 888 | Example |
| | 910**** | 150**** | | | |
| 3 | 920 | 150 | 675 | 882 | Example |
| 4 | 920 | <100 | 675 | 882 | Example |
| 5 | — | — | 710 | 882 | Example |
| 6 | 920 | 150 | 675 | 882 | Example |
| 7 | 925 | <100 | 685 | 882 | Example |
| 8 | 925 | <100 | 685 | 867 | Example |
| 9 | 1030 | <100 | 685 | 867 | Comparative Example |
| 10 | 825 | <100 | 690 | 881 | Example |
| 11 | 910 | <100 | 690 | 860 | Example |
| 12 | 910 | <100 | 760 | 860 | Comparative Example |
| 13 | 910 | 330 | 690 | 860 | Comparative Example |
| 14 | 910 | <100 | 690 | 846 | Example |
| 16 | 930 | <100 | 680 | 915 | Comparative Example |
| 17 | 820 | <100 | 680 | 752 | Comparative Example |
| 18 | 910 | <100 | 680 | 862 | Comparative Example |
| 19 | 930 | <100 | 680 | 895 | Comparative Example |
| 20 | 910 | <100 | 680 | 870 | Comparative Example |
| 21 | 900 | <100 | 690 | 854 | Comparative Example |
| 22 | 900 | <100 | 690 | 870 | Comparative Example |
| 23 | 920 | <100 | 690 | 885 | Comparative Example |
| 24 | 920 | <100 | 690 | 881 | Comparative Example |
| 25 | 910 | 150 | 690 | 859 | Comparative Example |
| 26 | 950 | <100 | 660 | 875 | Comparative Example |
| 27 | 930 | <100 | 690 | 894 | Example |
| 28 | 930 | <100 | 685 | 862 | Comparative Example |
| 29 | — | — | 660 | 860 | Example |

*Cooling stop temperature: surface temperature

**Reheating temperature

***Quenching cooling stop temperature: surface temperature

****Second quenching treatment

*****LF: heating-stirring-refining treatment, RH: vacuum degassing treatment

****** Sealing during casting from ladle into tundish, Performed: ○, Not Performed: X

******* Electromagnetic stirring in mold, Performed: ○, Not Performed: X

TABLE 3

| Steel | | Microstructure | | | | | | | Tensile Characteristics | | | |
|---|---|---|---|---|---|---|---|---|---|---|---|---|
| | | Number Density of Nitride-Based Inclusions* | | Number Density of Oxide-Based Inclusions* | | | | Grain Size Number of | | | | |
| Pipe No. | Steel No. | Less Than 4 μm | 4 μm or more | Less Than 4 μm | 4 μm or more | Kind** | Ratio of TM Microstructure (vol %) | Prior γ Grains | YS (MPa) | TS (MPa) | SSC Resistance | Note |
| 1 | A | 506 | 23 | 312 | 38 | TM + B | 98 | 9.5 | 885 | 972 | ○: good | Example |
| 2 | A | 453 | 25 | 345 | 30 | TM + B | 98 | 9.5 | 905 | 979 | ○: good | Example |
| 3 | B | 901 | 75 | 218 | 19 | TM + B | 98 | 10 | 881 | 975 | ○: good | Example |
| 4 | B | 872 | 66 | 204 | 13 | TM + B | 98 | 10.5 | 876 | 943 | ○: good | Example |

TABLE 3-continued

| Steel Pipe No. | Steel No. | Microstructure: Number Density of Nitride-Based Inclusions* Less Than 4 μm | Number Density of Nitride-Based Inclusions* 4 μm or more | Number Density of Oxide-Based Inclusions* Less Than 4 μm | Number Density of Oxide-Based Inclusions* 4 μm or more | Kind** | Ratio of TM Microstructure (vol %) | Grain Size Number of Prior γ Grains | Tensile Characteristics: Yield Strength YS (MPa) | Tensile Characteristics: Tensile Strength TS (MPa) | SSC Resistance | Note |
|---|---|---|---|---|---|---|---|---|---|---|---|---|
| 5 | B | 860 | 80 | 205 | 21 | TM + B | 98 | 8.5 | 925 | 1007 | ○: good | Example |
| 6 | B | 863 | 81 | 177 | 19 | TM + B | 99 | 10 | 882 | 954 | ○: good | Example |
| 7 | B | 876 | 77 | 203 | 22 | TM + B | 98 | 11 | 986 | 987 | ○: good | Example |
| 8 | C | 776 | 74 | 187 | 14 | TM + B | 98 | 10 | 917 | 991 | ○: good | Example |
| 9 | C | 784 | 83 | 225 | 19 | TM + B | 99 | 7.5 | 947 | 1024 | X: bad | Comparative Example |
| 10 | D | 887 | 81 | 176 | 18 | TM + B | 98 | 11 | 967 | 1031 | ○: good | Example |
| 11 | E | 469 | 55 | 246 | 31 | TM + B | 98 | 10 | 943 | 1018 | ○: good | Example |
| 12 | E | 429 | 46 | 229 | 27 | TM + B | 98 | 10.5 | 830 | 910 | — | Comparative Example |
| 13 | E | 445 | 63 | 278 | 22 | TM + B | 80 | 10.5 | 844 | 912 | — | Comparative Example |
| 14 | F | 569 | 65 | 323 | 27 | TM + B | 98 | 9.5 | 918 | 1000 | ○: good | Example |
| 16 | G | 370 | 50 | 254 | 15 | TM + B | 98 | 10.5 | 827 | 893 | — | Comparative Example |
| 17 | H | 667 | 51 | 300 | 21 | TM + B | 98 | 8.5 | 1089 | 1169 | X: bad | Comparative Example |
| 18 | I | 749 | 30 | 281 | 20 | TM + B | 98 | 10.5 | 988 | 1030 | X: bad | Comparative Example |
| 19 | J | 870 | 73 | 246 | 28 | TM + B | 98 | 11 | 991 | 1065 | X: bad | Comparative Example |
| 20 | K | 908 | 162 | 177 | 12 | TM + B | 96 | 10.5 | 879 | 980 | X: bad | Comparative Example |
| 21 | L | 1335 | 87 | 257 | 27 | TM + B | 98 | 10.5 | 865 | 1039 | X: bad | Comparative Example |
| 22 | M | 625 | 125 | 295 | 29 | TM + B | 98 | 10.5 | 895 | 977 | X: bad | Comparative Example |
| 23 | N | 875 | 27 | 635 | 36 | TM + B | 98 | 11 | 873 | 946 | X: bad | Comparative Example |
| 24 | O | 1453 | 134 | 263 | 17 | TM + B | 98 | 9.5 | 877 | 979 | X: bad | Comparative Example |
| 25 | P | 776 | 86 | 957 | 135 | TM + B | 98 | 10 | 890 | 970 | X: bad | Comparative Example |
| 26 | Q | 568 | 79 | 302 | 30 | TM + B | 98 | 9 | 1012 | 1103 | X: bad | Comparative Example |
| 27 | R | 650 | 48 | 325 | 28 | TM + B | 98 | 10.5 | 933 | 1003 | ○: good | Example |
| 28 | S | 1255 | 222 | 443 | 159 | TM + B | 98 | 10.5 | 904 | 975 | X: bad | Comparative Example |
| 29 | E | 455 | 49 | 266 | 29 | TM + B | 96 | 8.5 | 873 | 971 | ○: good | Example |

*Number Density: grains/100 $mm^2$

**TM: tempered martensite, B: bainite

In all the seamless steel pipes of Examples according to the present invention, a high yield strength YS of 862 MPa or higher and superior SSC resistance were obtained. On the other hand, in the seamless steel pipes of Comparative Examples which were outside of the ranges of the present invention, a desired high strength was not able to be secured due to low yield strength YS, or SSC resistance deteriorated.

In Steel Pipe No. 9 in which the quenching temperature was higher than the range of the present invention, prior austenite grains were coarsened, and SSC resistance deteriorated. In addition, in Steel Pipe No. 12 in which the tempering temperature was higher than the range of the present invention, the strength decreased. In addition, in Steel Pipe No. 13 in which the cooling stop temperature of the quenching treatment was higher than the range of the present invention, the desired microstructure containing martensite as a main phase was not able to be obtained, and the strength decreased. In addition, in Steel Pipe No. 16 in which the C content was lower than the range of the present invention, the desired high strength was not able to be secured. In addition, in Steel Pipe No. 17 in which the C content was higher than the range of the present invention, the strength increased, and SSC resistance deteriorated at the tempering temperature in the range of the present invention. In addition, in Steel Pipes No. 18, No. 19 and No. 26 in which the Mo content, the Cr content and the V content were lower than the ranges of the present invention, and SSC resistance deteriorated. In addition, in Steel Pipe No. 20 in which the Nb content was higher than the ranges of the present invention, in which the numbers of the inclusions were outside of the ranges of the present invention, and SSC resistance deteriorated. In addition, in Steel Pipes No. 21 and No. 22 in which the Ti/N were outside of the ranges of the present invention, in which the numbers of the inclusions were outside of the ranges of the present invention, and SSC resistance deteriorated. In addition, in Steel Pipe No. 23 in which the RH treatment time of 10 minutes was lower than the preferable ranges and the O (oxygen) content was higher than the range of the present invention, in Steel Pipe No. 24, the Ti content was higher than the range of the present invention, and in Steel Pipe No. 25, both the N content and the O (oxygen) content were higher than the range of the present invention, for these pipes, in which the numbers of the inclusions were outside of the ranges of the present invention, and SSC resistance deteriorated. In addition, in Steel Pipe No. 28 in which the components were within the ranges of the present invention but the numbers of inclusions were outside of the ranges of the present invention, SSC resistance deteriorated.

The invention claimed is:

1. A high-strength seamless steel pipe for oil country tubular goods having a yield strength (YS) of 862 MPa or higher, the steel pipe comprising, as a composition, by mass %, C: 0.20% to 0.50%,
Si: 0.05% to 0.40%,
Mn: 0.3% to 0.9%,
P: 0.015% or less,
S: 0.005% or less,
Al: 0.005% to 0.1%,
N: 0.006% or less,
Mo: more than 1.0% to 3.0% or less,
V: 0.01% to less than 0.05%,
Nb: 0.001% to less than 0.01%,
B: 0.0003% to 0.0030%,
O: 0.0030% or less,
Ti: 0.003% to 0.025%, and
a remainder comprising Fe and unavoidable impurities, wherein contents of Ti and N are adapted to satisfy Ti/N: 2.0 to 5.0, tempered martensite has a volume fraction of 95% or more, prior austenite grains have a grain size number of 8.5 or more, and in a cross-section perpendicular to a rolling direction, the number of nitride-based inclusions having a grain size of 4 μm or more is 100 or less per 100 $mm^2$, the number of nitride-based inclusions having a grain size of less than 4 μm is 1000 or less per 100 $mm^2$, the number of oxide-based inclusions having a grain size of 4 μm or more is 40 or less per 100 $mm^2$, and the number of oxide-based inclusions having a grain size of less than 4 μm is 400 or less per 100 $mm^2$.

2. The high-strength seamless steel pipe for oil country tubular goods according to claim 1, further comprising, one or more elements selected from, by mass %, Cr: 0.6% or less, Cu: 1.0% or less, Ni: 1.0% or less, and W: 3.0% or less.

3. The high-strength seamless steel pipe for oil country tubular goods according to claim 1, further comprising, by mass %, Ca: 0.0005% to 0.0050%.

4. The high-strength seamless steel pipe for oil country tubular goods according to claim 2, further comprising, by mass %, Ca: 0.0005% to 0.0050%.

5. A method of producing a high-strength seamless steel pipe for oil country tubular goods, the seamless steel pipe being the high-strength seamless steel pipe for oil country tubular goods according to claim 1;

the method comprising:

heating the steel pipe raw material to a heating temperature within a range of 1050° C. to 1350° C.;

performing hot working on the heated steel pipe raw material to form a seamless steel pipe having a predetermined shape;

cooling the seamless steel pipe at a cooling rate equal to or higher than that of air cooling after the hot working until a surface temperature of the seamless steel pipe reaches 200° C. or lower; and performing a tempering treatment in which the seamless steel pipe is heated to a temperature in a range of 600° C. to 740° C.

6. The method of producing a high-strength seamless steel pipe for oil country tubular goods according to claim 5, the method further comprising:

performing a quenching treatment on the seamless steel pipe at least once after the cooling and before the tempering treatment in which the seamless steel pipe is reheated to a temperature in a range of an $Ac_3$ transformation point to 1000° C. or lower and is rapidly cooled until the surface temperature of the seamless steel pipe reaches 200° C. or lower.

7. A method of producing a high-strength seamless steel pipe for oil country tubular goods, the seamless steel pipe being the high-strength seamless steel pipe for oil country tubular goods according to claim 2;

the method comprising:

heating the steel pipe raw material to a heating temperature within a range of 1050° C. to 1350° C.;

performing hot working on the heated steel pipe raw material to form a seamless steel pipe having a predetermined shape;

cooling the seamless steel pipe at a cooling rate equal to or higher than that of air cooling after the hot working until a surface temperature of the seamless steel pipe reaches 200° C. or lower; and performing a tempering treatment in which the seamless steel pipe is heated to a temperature in a range of 600° C. to 740° C.

8. A method of producing a high-strength seamless steel pipe for oil country tubular goods, the seamless steel pipe being the high-strength seamless steel pipe for oil country tubular goods according to claim 3;

the method comprising:

heating the steel pipe raw material to a heating temperature within a range of 1050° C. to 1350° C.;

performing hot working on the heated steel pipe raw material to form a seamless steel pipe having a predetermined shape;

cooling the seamless steel pipe at a cooling rate equal to or higher than that of air cooling after the hot working until a surface temperature of the seamless steel pipe reaches 200° C. or lower; and performing a tempering treatment in which the seamless steel pipe is heated to a temperature in a range of 600° C. to 740° C.

9. A method of producing a high-strength seamless steel pipe for oil country tubular goods, the seamless steel pipe being the high-strength seamless steel pipe for oil country tubular goods according to claim 4;

the method comprising:

heating the steel pipe raw material to a heating temperature within a range of 1050° C. to 1350° C.;

performing hot working on the heated steel pipe raw material to form a seamless steel pipe having a predetermined shape;

cooling the seamless steel pipe at a cooling rate equal to or higher than that of air cooling after the hot working until a surface temperature of the seamless steel pipe reaches 200° C. or lower; and performing a tempering treatment in which the seamless steel pipe is heated to a temperature in a range of 600° C. to 740° C.

10. The method of producing a high-strength seamless steel pipe for oil country tubular goods according to claim 7, the method further comprising:

performing a quenching treatment on the seamless steel pipe at least once after the cooling and before the tempering treatment in which the seamless steel pipe is reheated to a temperature in a range of an $Ac_3$ transformation point to 1000° C. or lower and is rapidly cooled until the surface temperature of the seamless steel pipe reaches 200° C. or lower.

11. The method of producing a high-strength seamless steel pipe for oil country tubular goods according to claim 8, the method further comprising:

performing a quenching treatment on the seamless steel pipe at least once after the cooling and before the tempering treatment in which the seamless steel pipe is reheated to a temperature in a range of an $Ac_3$ transformation point to 1000° C. or lower and is rapidly cooled until the surface temperature of the seamless steel pipe reaches 200° C. or lower.

12. The method of producing a high-strength seamless steel pipe for oil country tubular goods according to claim 9, the method further comprising:

performing a quenching treatment on the seamless steel pipe at least once after the cooling and before the tempering treatment in which the seamless steel pipe is reheated to a temperature in a range of an $Ac_3$ transformation point to 1000° C. or lower and is rapidly cooled until the surface temperature of the seamless steel pipe reaches 200° C. or lower.

* * * * *